United States Patent [19]

Ohgami et al.

[11] 4,385,608

[45] May 31, 1983

[54] SYSTEM FOR CONTROLLING AIR-FUEL RATIO

[75] Inventors: Masaaki Ohgami, Musashino; Hiroki Yasuda, Hachioji; Hitoshi Suzuki, Chofu, all of Japan

[73] Assignees: Fuji Jukogyo Kabushiki Kaisha, Tokyo; Nissan Motor Co., Ltd., Yokohama, both of Japan

[21] Appl. No.: 174,378

[22] Filed: Aug. 1, 1980

[30] Foreign Application Priority Data

Aug. 2, 1979 [JP] Japan ..... 54-98924

[51] Int. Cl.[3] ..... F02M 7/00

[52] U.S. Cl. ..... 123/440

[58] Field of Search ..... 123/440, 489, 492

[56] References Cited

U.S. PATENT DOCUMENTS

| | | | |
|---|---|---|---|
| 4,075,982 | 2/1978 | Asano et al. | 123/440 |
| 4,089,313 | 5/1978 | Asano et al. | 123/440 |
| 4,131,091 | 12/1978 | Asano et al. | 123/492 X |
| 4,144,847 | 3/1979 | Hosaka | 123/489 X |
| 4,187,812 | 2/1980 | Hosaka et al. | 123/492 X |
| 4,240,389 | 12/1980 | Shimazaki | 123/492 |

*Primary Examiner*—Tony M. Argenbright

*Attorney, Agent, or Firm*—Martin A. Farber

[57] ABSTRACT

A system for controlling the air-fuel ratio for an internal combustion engine having an intake passage, an exhaust passage, a detector such as an oxygen sensor for detecting the concentration of oxygen in the exhaust gases, an air-fuel mixture supply unit, an on-off type electromagnetic valve for correcting the air-fuel ratio of the air-fuel mixture supplied by the air-fuel mixture supply unit, and an electronic control circuit for producing square wave pulses in dependency on the output signal from the detector for driving the on-off type electromagnetic valve. The system comprises a venturi for producing a vacuum dependent on rapid acceleration, a vacuum sensor for sensing the vacuum in the venturi at rapid acceleration of the internal combustion engine and producing an output signal dependent thereon, an intake opening in the venturi for communicating the vacuum with said vacuum sensor, pulse width modulator for producing a pulse width modulating signal when an output signal of the vacuum sensor rises above a predetermined level at a rapid acceleration, the pulse width modulator being connected to the electronic control circuit, such that said pulse width modulating signal is fed to said electronic control circuit for modulating the width of said square wave pulses in dependency on the rapid acceleration for enriching the air-fuel mixture.

9 Claims, 5 Drawing Figures

SYSTEM FOR CONTROLLING AIR-FUEL RATIO

BACKGROUND OF THE INVENTION

The present invention relates to a system and method for controlling the air-fuel ratio for an internal combustion engine emission control system with a three-way catalyst, and more particularly to a system for correcting the deviation of the air-fuel ratio during rapid acceleration of the engine.

Such a control system is, as in U.S. Pat. No. 4,132,199, a feedback control system, in which an oxygen sensor is provided to sense the oxygen concentration in exhaust gases to generate an electrical signal as an indication of the air-fuel ratio of the burned air-fuel mixture. The control system operates to actuate an air-fuel mixture supply means to control the air-fuel ratio of the mixture to the stoichiometric air-fuel ratio according to the signal from the oxygen sensor.

The system may sufficiently control the air-fuel ratio during the usual operation of the engine. However, during rapid acceleration of the engine, the system cannot immediately respond to the variation of the air-fuel ratio of the mixture as described hereinafter.

If the engine is rapidly accelerated, the amount of induced air immediately increases by an increase of the vacuum in the intake passage. On the other hand, the air-fuel mixture supply means does not rapidly operate in response to the increase of the amount of induced air. As a result, the air-fuel ratio increases and consequently, a lean air-fuel mixture is supplied. The air-fuel ratio gradually decreases to a proper ratio as the speed of the engine increases.

SUMMARY OF THE INVENTION

An object of the present invention is to provide a system which can correct the deviation of the air-fuel ratio to the lean side just after the rapid acceleration of the engine.

According to the present invention, there is provided a system for controlling the air-fuel ratio for an internal combustion engine having an intake passage, an exhaust passage, a throttle valve, detecting means for detecting the concentration of a constituent of the exhaust gases passing through the exhaust passage, air-fuel mixture supply means, an electronic control circuit for producing square wave pulses in accordance with the output signal of said detecting means and an on-off type electromagnetic valve actuated by the square wave pulses from the electronic control circuit for correcting the air-fuel ratio of the air-fuel mixture supplied by said air-fuel mixture supply means, the system comprising a venturi for producing a vacuum dependent on rapid acceleration, a vacuum sensor for sensing the vacuum in the venturi at rapid acceleration of the internal combustion engine and producing an output signal dependent thereon, an intake opening in the venturi for communicating the vacuum with said vacuum sensor, pulse width modulator for producing a pulse width modulating signal when the output signal of the vacuum sensor rises above a predetermined level at a rapid acceleration, the pulse width modulator being connected to the electronic control circuit, such that said pulse width modulating signal is fed to said electronic control circuit for modulating the width of said square wave pulses in dependency on the rapid acceleration for enriching the air-fuel mixture.

Other objects and features of the present invention will become apparent from the following description of a preferred embodiment with reference to the accompanying drawings.

BRIEF DESCRIPTION OF THE INVENTION

Figure 3:
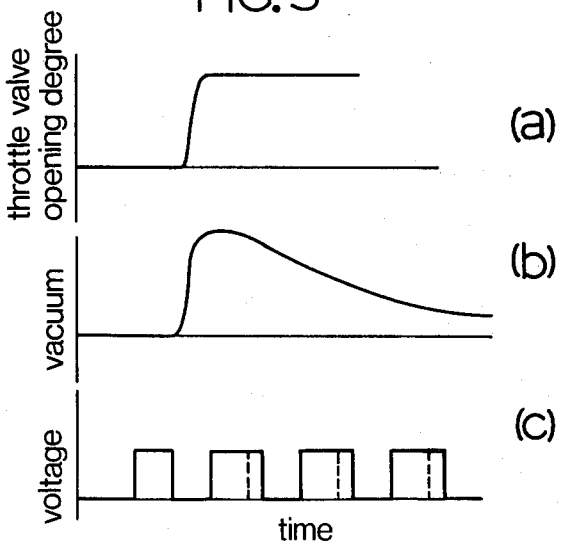
Figure 4:
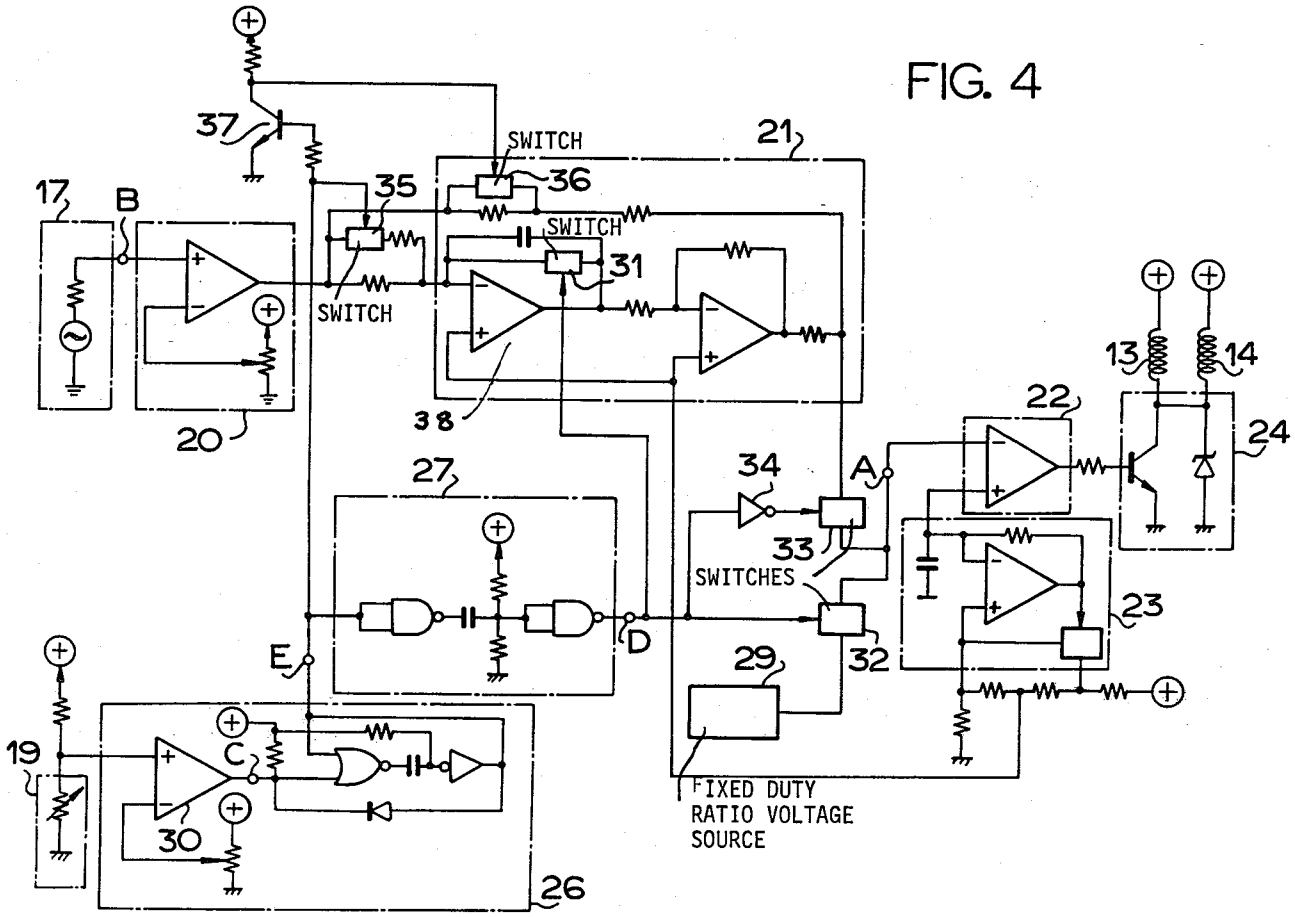

FIGS. 3(*a*), (*b*) and (*c*) are graphs illustrating the operation of the system of the present invention;

FIG. 4 shows an electronic control circuit; and

Figure 5:
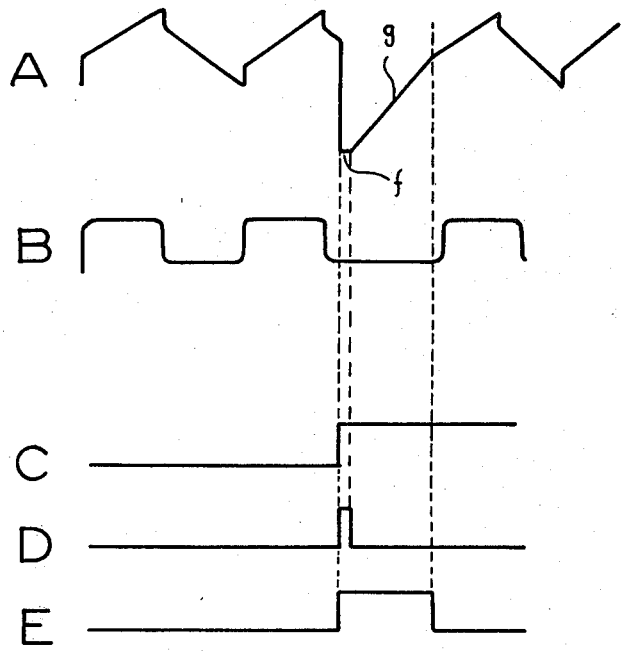

FIG. 5 shows wave forms at various locations in FIG. 4.

DETAILED DESCRIPTION OF THE PREFERRED EMBODIMENT

Figure 1:
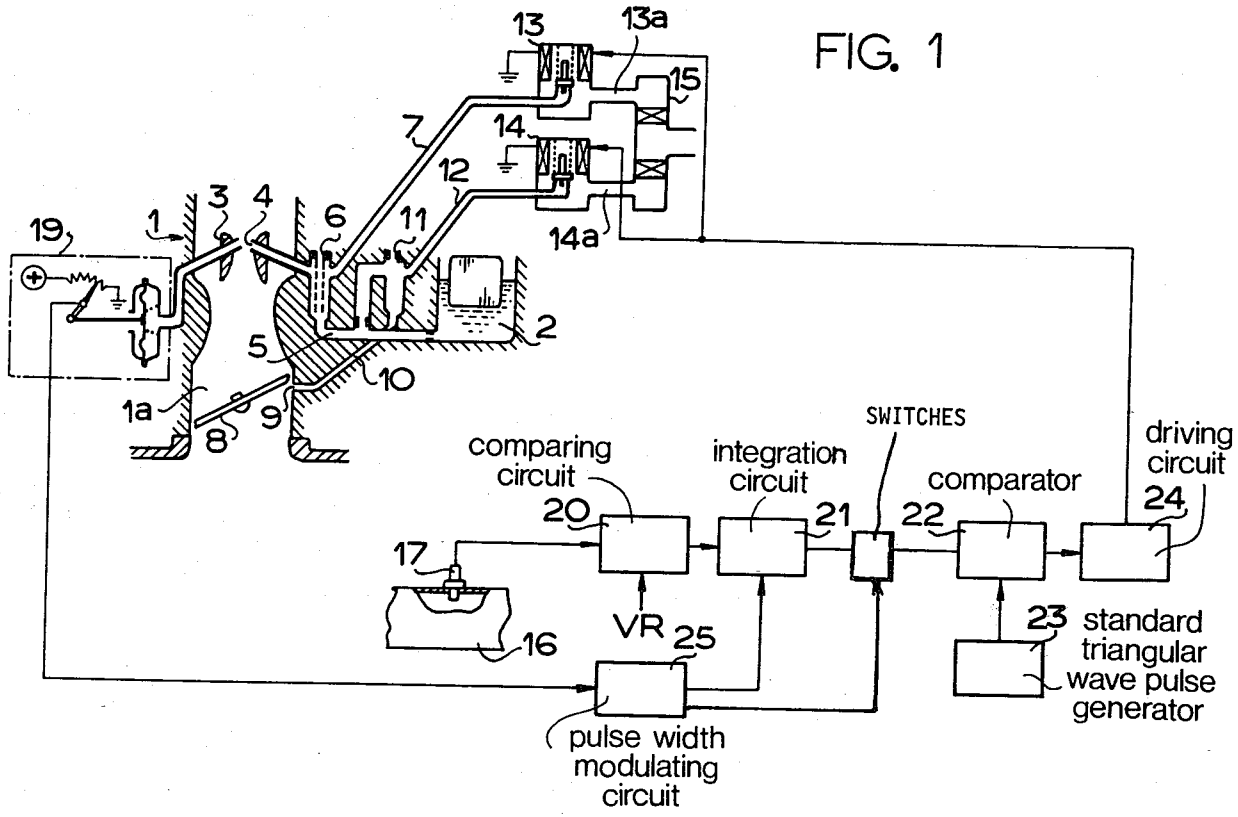
FIG. 1 is a schematic view of a system for controlling air-fuel ratio partly in section and partly broken away.

Referring to FIG. 1, a carburetor 1 communicates with an internal combustion engine (not shown). The carburetor 1 comprises a float chamber 2, a venturi 3 formed in an intake passage 1*a*, a nozzle 4 communicating with the float chamber 2 through a main fuel passage 5, and a slow port 9 provided near a throttle valve 8 in the intake passage communicating with the float chamber 2 through a slow fuel passage 10. Air correcting passages 7 and 12 are disposed in parallel to a main air bleed 6 and a slow air bleed 11, respectively. On-off type electromagnetic valves 13 and 14 are provided for the air correcting passages 7 and 12, respectively. Inlet ports 13*a* and 14*a* of each on-off electromagnetic valve 13 and 14 respectively communicates with the atmosphere through an air filter or air cleaner 15. An oxygen sensor 17 is disposed in an exhaust pipe 16 which communicates with the internal combustion engine. The sensor 17 detects the oxygen content of the exhaust gases. A three-way catalytic converter (not shown) is provided in the exhaust pipe 16 downstream of the oxygen sensor 17. A vacuum sensor 19 communicates with the venturi 3 and is responsive to the vacuum condition therein. The sensor 19 comprises a potentiometer (known per se) operatively communicating with the venturi 3 for converting the vacuum in the intake passage into a voltage signal. The output signal of the oxygen sensor 17 is applied to a comparing circuit 20 of an electronic control system. The comparing circuit 20 operates to compare the input signal from the oxygen sensor 17 with a reference value $V_R$ corresponding to the stoichiometric air-fuel ratio and to determine whether the input signal is rich or lean compared with the reference stoichiometric air-fuel ratio to produce a comparison signal dependent thereon.

The comparison signal is applied to an integration circuit 21, where the signal is converted into an integration signal which varies in an opposite direction to the direction represented by the input comparison signal. The integration signal is compared in a comparator 22 with triangular wave pulses applied from a standard triangular wave pulse generator 23 so that square wave pulses are produced at the output of the comparator 22. The square wave pulses are fed to both of the on-off type electromagnetic valves 13 and 14 through a driving circuit 24.

When a rich air-fuel ratio is determined, the comparator 22 produces output pulses having a greater pulse duty ratio, whereby the opening times of the on-off type electromagnetic valves 13 and 14 increase and as a result the amount of air passing through the valves 13 and 14 increases. Thus, the amount of air in the mixture fed from the carburetor 1 increases to thereby increase the air-fuel ratio. When a lean air-fuel ratio is determined, the output of the comparator 22 has a smaller pulse duty ratio, whereby the air-fuel ratio is decreased to enrich the mixture fed from the carburetor.

Figure 2:
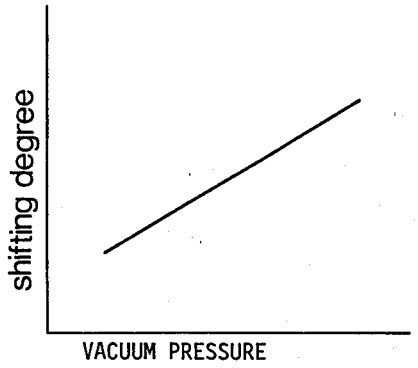
FIG. 2 is a graph showing the characteristics of the pulse width modulating circuit.

In accordance with the present invention, the voltage output of the vacuum sensor 19 is connected to a pulse width modulating circuit 25. The pulse width modulating circuit 25 is designed so as to produce pulse width modulating signals D, E (FIG. 5) when the signal from the vacuum sensor 19 exceeds a predetermined level by a rapid acceleration. The amount of the pulse width modulating signal increases with increasing vacuum pressure as shown in FIG. 2.

When the throttle valve 8 is rapidly opened for acceleration and the vacuum pressure rises above a predetermined level as shown in FIGS. 3(*a*), (*b*), the pulse width modulating circuit operates to produce pulse width modulating signals D, E (FIG. 5). The pulse width modulating signals D, E (FIG. 5) are fed to the integration circuit 21 and the corrected output signal thereof is to fed to the input of the comparator 22. Thus, the output signal from the integration circuit 21 is corrected, and the pulse width of the pulse produced by the comparator circuit 22 is changed. FIG. 3(*c*) shows such a pulse width as indicated by dashed lines. By the pulse width modulation, the pulse duty ratio of the electromagnetic valves 13 and 14 is decreased, so that the air-fuel ratio of the mixture is decreased. Thus, the mixture can be enriched in accordance with the increase of the vacuum pressure in the acceleration. The enrichment is effected during rapid acceleration only. Therefore, an excessive enrichment of the mixture during the usual operation of the engine can be prevented.

FIG. 4 shows an electronic control circuit, in which each block depicted by dash dotted lines corresponds to that of the block diagram of FIG. 1. The pulse width modulating circuit 25 of FIG. 4 comprises a one pulse generating circuit 26, a small width pulse generating circuit 27, and a fixed duty ratio voltage source 29. When the output voltage of the vacuum sensor 19 exceeds the predetermined level, an operational amplifier 30 in the circuit 26 produces an output signal (C) (FIG. 5(*c*)) and the circuit 26 generates a pulse (E) (FIG. 5(E)). By the pulse (E), the circuit 27 generates a small pulse (D) which is fed to gates of switches 31 and 32 to close them and to the gate of a switch 33 via an inverter 34 to open it. The switches 31 and 32 are closed and the switch 33 is open during this pulse (D). Further, the pulse (E) is fed to the gate of a switch 35 and to the gate of a switch 36 through a transistor 37. Consequently, the capacitor in an integrator 38 in the integration circuit 21 is discharged during the pulse D and the gain of the feedback circuit 21 is increased during the pulse E. But during the pulse (D) closing the switch 32 and opening switch 31, the fixed duty ratio voltage for enrichment of the mixture is supplied from the fixed duty ratio voltage source 29 to the comparator 22 causing the output signal A to drop to a predetermined fixed low value f. After the short pulse D ends switches 31 and 32 open and switch 33 closes enabling the increased gain output (effected by continuing signal E) of circuit 21 to provide corrected slope g at signal A. FIG. 5(B) shows the output of the oxygen sensor 17 at (B) in FIG. 4 and FIG. 5(A) shows the control signal at (A) which is corrected by the pulse width modulating signals. The corrected control signal f, g causes the comparator 22 to produce a small duty ratio pulse signal. Thus, the on-off type electromagnetic valves 13, 14 are closed longer and less air enters the air-fuel mixture, whereby the mixture supplied by the carburetor is enriched during the pulse (E).

In accordance with the present invention, a temporary deviation of the air-fuel ratio toward the lean side during rapid acceleration can be prevented, whereby the acceleration performance of the engine can be improved.

What is claimed is:

1. In a system for controlling the air-fuel ratio for an internal combustion engine having a carburetor with an intake passage, air-fuel mixture supply means for supplying an air-fuel mixture to the intake passage, an exhaust passage communicating with the engine, a throttle valve in the intake passage, detecting means for detecting the concentration of a constituent of exhaust gases passing through said exhaust passage and providing an output signal dependent thereon, an electronic control circuit means for producing square wave pulses in dependency on said output signal of said detecting means, and an on-off type electromagnetic valve means actuated by the square wave pulses from said electronic control circuit means for correcting the air-fuel ratio of the air-fuel mixture supply means, the improvement comprising a venturi means in the intake passage upstream of said throttle valve for producing vacuum dependent on rapid acceleration of said internal combustion engine, a vacuum sensor means for sensing said vacuum in said venturi means at rapid acceleration of the internal combustion engine and for producing a second output signal dependent thereon, pulse width modulating means for producing a pulse width modulating signal when the second output signal of said vacuum sensor means rises above a predetermined level at rapid acceleration, said pulse width modulating means being connected to said electronic control circuit means for feeding said pulse width modulating signal to said electronic control circuit means for modulating the width of said square wave pulses in dependency on said rapid acceleration for enriching the air-fuel mixture.

2. The system for controlling the air-fuel ratio for an internal combustion engine according to claim 1 wherein said vacuum sensor means is for producing said second output signal changing in dependency on the magnitude of the rapid acceleration.

3. The system for controlling the air-fuel ratio for an internal combustion engine according to claim 1 further comprising intake opening means provided in said venturi means for introducing said vacuum to said vacuum sensor means, said vacuum sensor means is responsive to the vacuum in the venturi means above a predetermined value.

4. The system according to claim 1 wherein said vacuum sensor means comprises a diaphragm means defining a chamber communicating with said venturi means and a potentiometer movably connected to said diaphragm means.

5. The system according to claim 1 wherein said pulse width modulating means includes a fixed duty ratio voltage source, a one pulse generating circuit connected to said vacuum sensor means and a small width pulse generating circuit means connected to an output of said one pulse generating circuit, said electronic control circuit means includes an integration circuit connected to said pulse width modulating circuit and a comparing circuit connected to said detecting means and to said integration circuit, and a driving circuit means for driving the on-off type electromagnet valve means, a comparator operatively connected to an output of said integration circuit and to said driving circuit means and a standard triangular wave pulse generator connected to an input of said comparator, a first switching means is connected between said output of said integration circuit and another input of said comparator, a second switching means is connected between said fixed duty ratio voltage source and said another input of said comparator, said small width pulse generating circuit means has an output connected to switching gates of said first and second switching means for generating a small width pulse upon receiving a pulse signal from said one pulse generating circuit for switching said first and second switching means during said rapid acceleration when the output voltage of the vacuum sensor means exceeds the predetermined level such that said first switching means opens and said second switching means closes during said small width pulse and vice versa otherwise, said small width pulse signal and said pulse signal constituting said pulse width modulating signal.

6. The system according to claim 5, further comprising third switching means disposed between said comparing means and said integration circuit and a fourth switching means disposed in said integration circuit and comprising means for increasing the gain in said integration circuit upon receiving said pulse signal from said one pulse generating circuit during said rapid acceleration when the output voltage of said vacuum sensor means exceeds the predetermined level.

7. The system according to claim 6, wherein said integration circuit includes a fifth switching means connected to the output of said small width pulse generating circuit for closing said fifth switching means and converting said integration circuit into an ordinary operational amplifier when said first switching means opens and said second switching means closes by said small width pulse.

8. The system according to claim 1, wherein said pulse width modulating means is for increasing the pulse width modulating signal with increasing vacuum.

9. In a method for controlling the air-fuel ratio for an internal combustion engine having a carburetor with an intake passage, air-fuel mixture supply means for supplying an air-fuel mixture to the intake passage, an exhaust passage communicating with the engine, a throttle valve in the intake passage, detecting means for detecting the concentration of a constituent of exhaust gases passing through said exhaust passage and producing an output signal dependent thereon, an electronic control circuit means for producing square wave pulses in dependency on said output signal of said detecting means, and an on-off type electromagnetic valve means actuated by the square wave pulses from said electronic control circuit means for correcting the air-fuel ratio of the air-fuel mixture supplied by said air-fuel mixture supply means, the improvement comprising producing a vacuum dependent on a rapid acceleration of the engine in a venturi in the intake passage upstream of the throttle valve and detecting the vacuum and producing a second output signal dependent thereon, producing a pulse width modulating signal when the second output signal rises above a predetermined level upon rapid acceleration, and modulating the width of said square wave pulses by the pulse width modulating signal in dependency on said rapid acceleration for enriching the air-fuel mixture.

* * * * *